United States Patent [19]

Ootsuka

[11] Patent Number: 5,075,660

[45] Date of Patent: Dec. 24, 1991

[54] ELECTROMAGNETIC CONTRACTOR AND FABRICATION METHOD THEREFOR

[75] Inventor: Shigeharu Ootsuka, Nagoya, Japan

[73] Assignee: Mitsubishi Denki Kabushiki Kaisha, Tokyo, Japan

[21] Appl. No.: 497,203

[22] Filed: Mar. 22, 1990

[30] Foreign Application Priority Data

Mar. 24, 1989 [JP] Japan ..... 1-72680

[51] Int. Cl.[5] ..... H01H 67/02

[52] U.S. Cl. ..... 335/131; 335/78

[58] Field of Search ..... 335/78–85, 335/124–132, 136

[56] References Cited

U.S. PATENT DOCUMENTS 3,354,414 11/1967 Fluder et al. ..... 335/132
3,671,891 6/1972 Usui et al. ..... 335/126
4,490,701 12/1984 Dietrich et al. ..... 335/132

FOREIGN PATENT DOCUMENTS 56-128533 10/1981 Japan .
59-132535 7/1984 Japan .
61-47034 3/1986 Japan .

*Primary Examiner*—Leo P. Picard
*Assistant Examiner*—Lincoln Donovan
*Attorney, Agent, or Firm*—Burns, Doane, Swecker & Mathis

[57] ABSTRACT

In an electromagnetic contactor, a link (6), which transmits a motion of a movable iron core (4) to a movable contact (15), is formed into a specific configuration including a flat-board-shaped part which has both predetermined rigidity and plasticity, thereby to enable the adjustment by transforming its shape.

4 Claims, 9 Drawing Sheets

ELECTROMAGNETIC CONTRACTOR AND FABRICATION METHOD THEREFOR

FIELD OF THE INVENTION AND RELATED ART STATEMENT

1. Field of the Invention

The present invention relates to an electromagnetic contactor and more particularly to an improvement in adjusting an over-travel (a moving stroke of a crossbar from the beginning of contact to the completion of attraction) for its contact and a gap between a fixed contact and a movable contact.

2. Description of the Related Art

FIG. 6 is a cross-sectional view showing a conventional electromagnetic contactor disclosed in the Japanese unexamined patent application (TOKKAI)Sho 63-79304. This electromagnetic contactor includes a polarized electromagnet. In FIG. 6, a channel-shaped fixed iron core 101, an L-shaped magnetic pole sheet 102 and a coil spool 105 on which a coil 105A is wound are fixedly mounted to a case 130 to constitute an electromagnet. An H-shaped movable iron core 104 is movably mounted to the case 130 in the right and left direction of the figure. A right end of the movable iron core 104 is engaged with a link 106 via a linkage pin 108. The link 106 is made of molded resin etc. and is pivotally mounted to the case 130 around a fulcrum pin 107. A pair of spacers 109*a* and 109*b* are provided in order to adjust both a stroke of the movable iron core 104 and attraction force between the movable iron core 104 and the fixed iron core 101, by selection of their thicknesses. The above-mentioned parts constitute an electromagnet part A within the case 130. A crossbar 110 is engaged with the link 106 and makes sliding action to carry movable contacts (not shown), which are mounted on the crossbar 110, toward fixed contact (not shown). The crossbar 110 with the movable contacts held thereon and the fixed contacts, which form a contact part B, are mounted within a cover 120. The cover 120 couples with the case 130, thereby forming an exterior part of the electromagnetic contactor. The contact part B is isolated from the electromagnet part A by a shielding sheet 140 made of a flat insulation board e.g. of a synthetic resin. The crossbar 110 is urged from the cover 120 to move rightward by a compression spring 150. More specifically, the fulcrum pin 107 is inserted into a hole (not shown) formed in an illustration-omitted part of the coil spool 105, and the fixed iron core 101 and the magnetic pole sheet 102 are fixed in grooves (not shown) formed in the coil spool 105. The coil spool 105 is fixedly positioned by a pair of projections 111.

Next, operation of the above-mentioned conventional electromagnetic contactor is described. A state shown by FIG. 6 is a released state of the electromagnetic contactor. When the coil 105A is excited from the released state, the movable iron core 104 is attracted to the fixed iron core 101 in a direction shown by an arrow X. The crossbar 110 is thereby pushed leftward via the link 106 and makes sliding motion in a direction shown by an arrow Y. At that time, the movable contacts make contact with the fixed contacts, thereby electrically making contact. When excitation of the coil 105A is lost, the crossbar 110 is pushed rightward owing to an expansion force of the compression spring 150 and returns to the released state. At that time, the movable contacts detach from the fixed contacts, thereby electrically breaking contact. In breaking contact, arcs are generated between the fixed contacts and the movable contacts.

In the above-mentioned electromagnetic contactor, it is very important to precisely locate a contact position S of the crossbar 110 and the link 106 at a predetermined position. This is because the improper contact position deteriorates operational characteristics of the electromagnetic contactor and shortens a lifetime of the contacts. Adjustment of the contact position S is carried out by exchanging the spacer 109*a* and/or 109*b* for other spacers having different thicknesses. Therefore, adjustment of the contact position S necessitates to disassemble the electromagnet part A. As a result, it takes long time to adjust the contact position S, and also such adjustment is not easy.

OBJECT AND SUMMARY OF THE INVENTION

An object of the present invention is to offer an electromagnetic contactor in which the contact position is easily adjusted without exchanging the spacer and disassembling of the electromagnet part.

In order to achieve the above-mentioned object, the electromagnetic contactor of the present invention comprises:

a casing:

a cover coupled with the casing;

an electromagnet unit including an electromagnet fixedly mounted to the casing and a movable iron core movably mounted to the casing;

a fixed contact fixedly mounted in the cover;

a crossbar which is slidably mounted in the cover and has a movable contact to move in and out of contact with the fixed contact;

a spring for urging the crossbar to move toward a predetermined direction; and a link which has a first end part for engaging with the movable iron core and a second end part for moving the crossbar against an urging force of the spring, the second end part being of flat-board-shape and being projected out of the casing.

In an aspect of a method for fabricating the electromagnetic contactor, the present invention comprises:

a first step of assembling an electromagnet unit including a movable iron core;

a second step of fitting a mechanical link, which is for making a mechanical linkage of the movable iron core with a movable contact, to the movable iron core;

a third step of mounting the electromagnet unit and the link to a casing;

a fourth step of adjusting a position of the link in relation to a reference surface of the electromagnet unit by bending a part of the link;

a fifth step of coupling a cover with the casing, the cover including a fixed contact and the movable contact.

While the novel features of the invention are set forth particularly in the appended claims, the invention, both as to organization and content, will be better understood and appreciated, along with other objects and features thereof, from the following detailed description taken in conjunction with the drawings.

It will be recognized that some or all of the Figures are schematic representations for purposes of illustration and do not necessarily depict the actual relative sizes or locations of the elements shown.

DESCRIPTION OF THE PREFERRED EMBODIMENT

Hereafter, a preferred embodiment of the present invention is described with reference to the accompanying drawings.

Figure 1:
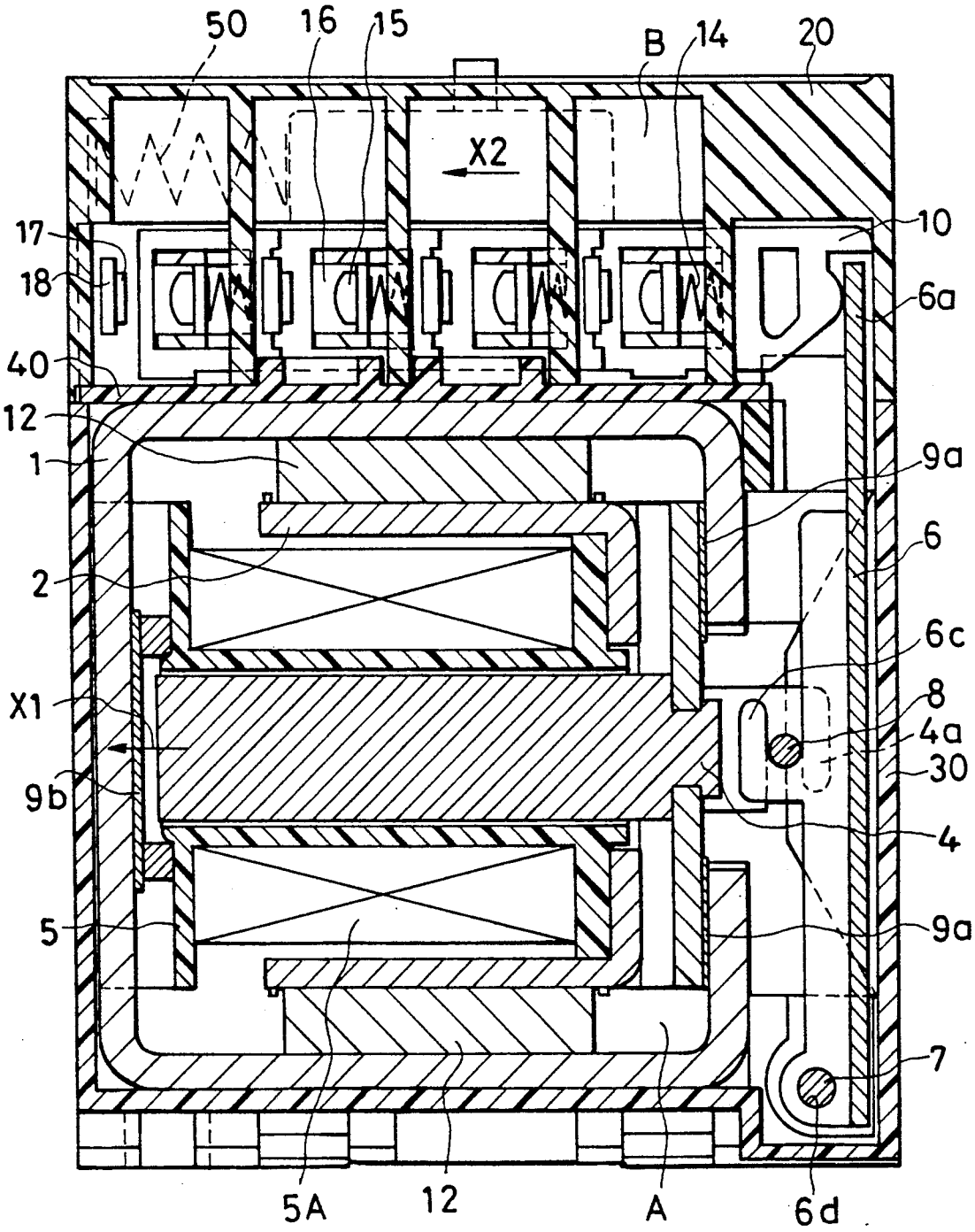
FIG. 1 is a cross-sectional view showing an electromagnetic contactor of the present invention.

FIG. 1 is a cross-sectional view showing an electromagnetic contactor of the present invention. In FIG. 1, a channel-shaped fixed iron core 1, L-shaped magnetic pole sheets 2 and a coil spool 5 on which a coil 5A is wound are fixedly mounted to a case 30 to constitute an electromagnet. Permanent magnets 12 are provided between the fixed iron core 1 and the magnetic pole sheets 2 in order to assist the attraction by the electromagnet to thereby lighten a burden of the coil 5A. These permanent magnets 12 also improve a performance to withstand the mechanical shock from the outside. A T-shaped movable iron core 4 is movably mounted to the case 30 in the right and left direction of the figure. A right end of the movable iron core 4 is engaged with a link 6 via a linkage pin 8. The link 6 is made of a metal sheet and is pivotally mounted to the case 30 around a fulcrum pin 7. Spacers 9*a* and 9*b* are provided in order to adjust attraction force between the movable iron core 4 and the fixed iron core 1. The above-mentioned parts constitute an electromagnet part A within the case 30. A crossbar 10 is engaged with the link 6 and makes sliding action in a first direction to carry movable contacts 15 toward fixed contacts 17, respectively. Each of the movable contacts 15 is provided on a movable contact arm 16, and each of the fixed contacts 17 is provided on a fixed contact arm 18. The movable contact arm 16 is slidably held by the crossbar 10 and is urged by a compression spring 14 in order to give a contacting pressure to the movable contact 15. The fixed contacts 17 and the fixed contact arms 18 are built in a cover 20, and the crossbar 10 with the movable contacts 15 is mounted within the cover 20. These components mounted within the cover 20 constitute a contact part B against the electromagnet part A. The cover 20 couples with the case 30, thereby forming an exterior part of the electromagnetic contactor. The contact part B is isolated from the electromagnet part A by a shielding sheet 40 made of a flat insulation board e.g. of a synthetic resin. The crossbar 10 is urged from the cover 20 to move rightward by a compression spring 50.

Figure 2:
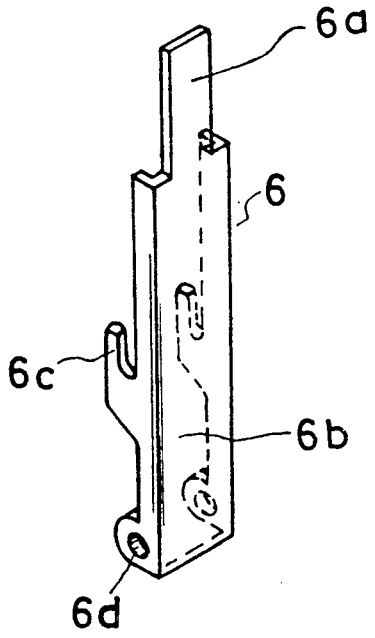
FIG. 2 is a perspective view showing a link 6 in FIG. 1.

FIG. 2 is a perspective view showing the link 6. A top-end part 6*a* (hereinafter is referred to as a flat board part) of the link 6 is of flat-board-shape without a bent portion and is to be engaged with the crossbar 10 (FIG. 1). The flat-board-shape of the top-end part 6*a* extends in a plane substantially perpendicularly to the first direction, as is shown in FIGS. 1–3*b* and 4. A medium and lower part 6*b* is of substantially U-shape, and a pair of hooks 6*c* and a pair of holes 6*d* are formed in both sides of the part 6*b*. Each of the hooks 6*c* is to be engaged with a hook 4*a* (FIG. 1) via the linkage pin 8, and the fulcrum pin 7 (FIG. 1) is inserted into the holes 6*d*.

Figure 3A:
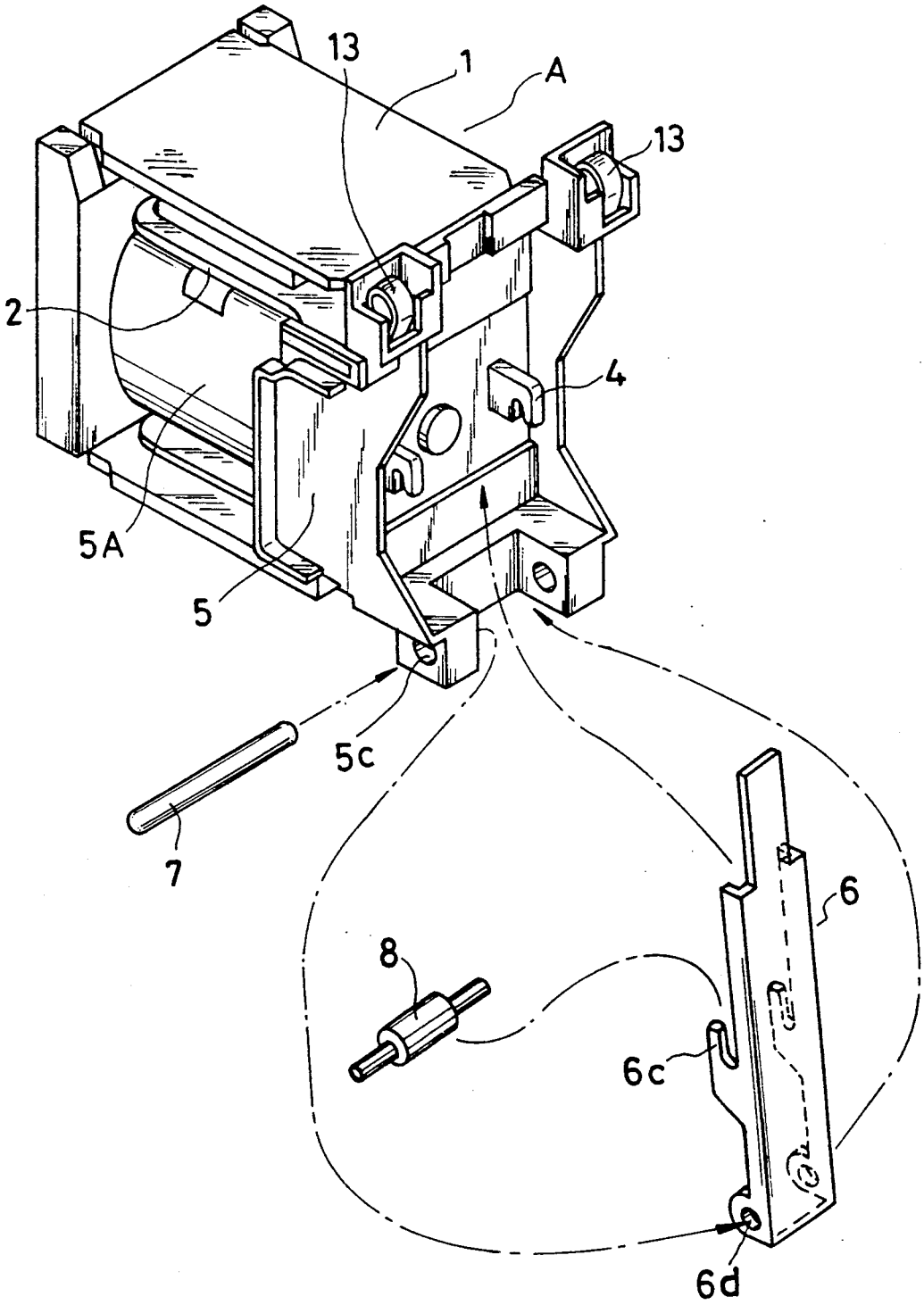
FIG. 3*a* is a perspective view showing an electromagnet part A in FIG. 1 and an assembling procedure of the link 6 thereto.
Figure 3B:
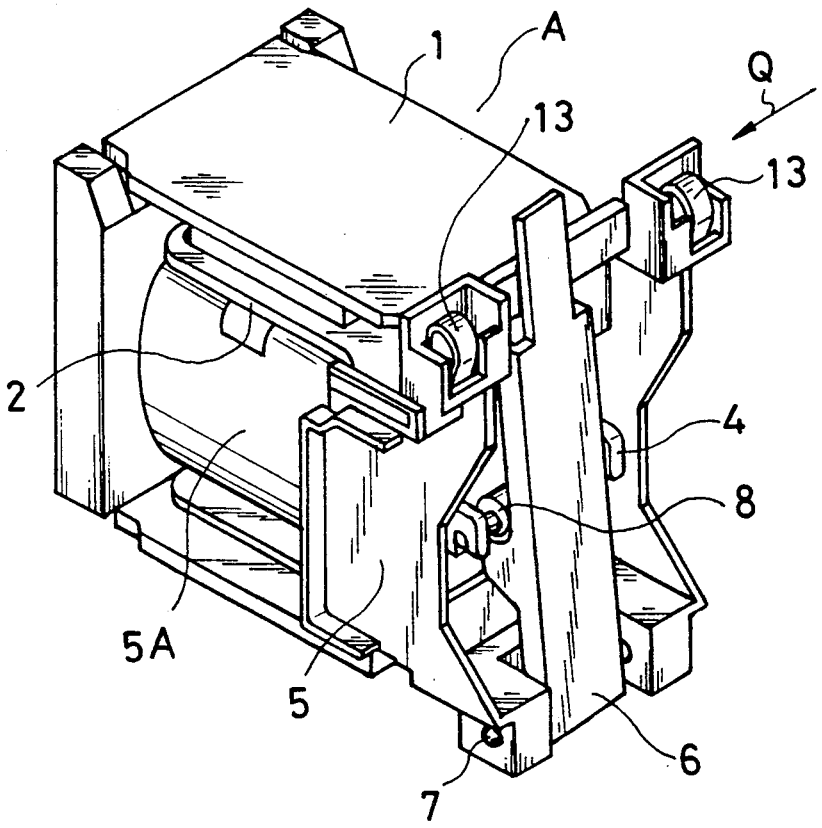
FIG. 3*b* is a perspective view showing the electromagnet part A after completion of assembly.

FIG. 3*a* is a perspective view showing the electromagnet part A and an assembling procedure of the link 6 thereto. The fulcrum pin 7 is inserted into holes 5*c* of the coil spool 5 and the holes 6*d* of the link 6. The fixed iron core 1 and the magnetic pole sheet 2 are tightly fit onto the coil spool 5. FIG. 3*b* is a perspective view showing the electromagnet part A after completion of assembly. The electromagnet part A is thus integrated into one unit body. An excitation voltage is supplied to the coil 5A from a pair of contact terminals 13 which are to be connected to coil terminals (not shown).

Figure 3C:
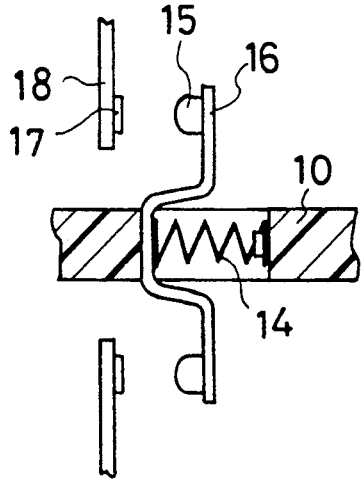
FIGS. 3*c*, 3*d* and 3*e* are illustrations showing the released state of the movable contact 15, a beginning state of making contact and a finished state of the attraction, respectively.
Figure 3D:
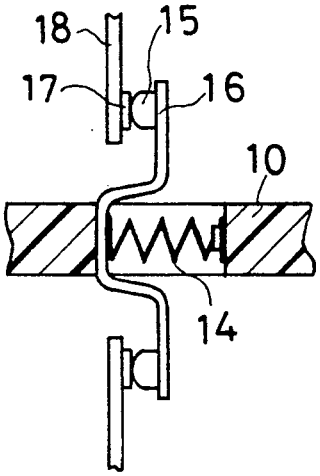
Figure 3E:
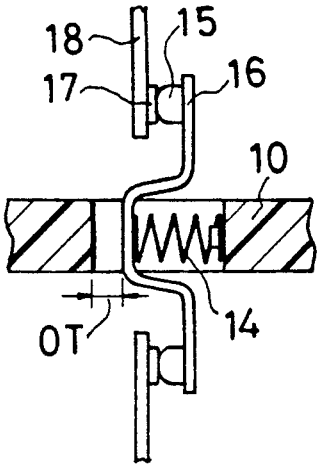

Next, operation of the above-mentioned electromagnetic contactor is described. A state shown by FIG. 1 is a released state of the electromagnetic contactor. When the coil 5A is excited from the released state, the movable iron core 4 is attracted to the fixed iron core 1 in a direction shown by an arrow X1. The crossbar 10 is thereby pushed leftward via the link 6 and makes sliding motion in a direction shown by an arrow X2. At that time, the movable contacts 15 make contact with the fixed contacts 17, thereby electrically making contact. FIGS. 3*c*, 3*d* and 3*e* are illustrations showing the released state of the movable contact 15, a beginning state of making contact and a finished state of the attraction, respectively. In FIG. 3*d*, the movable contact 15 has made contact with the fixed contact 17. From this state, the crossbar 10 further moves leftward, thereby reaching the state of FIG. 3*e*. In FIG. 3*e*, the spring 14 is contracted by relative movement between the movable contact arm 16 and the crossbar 10 by a length OT defined as the overtravel. In FIG. 1 again, when excitation of the coil 5A is lost, the crossbar 10 is pushed rightward by an expansion force of the compression spring 50 and returns to the released state. At that time, the movable contacts 15 detach from the fixed contacts 17, thereby electrically breaking contact. In breaking contact, arcs are generated between the fixed contacts 17 and the movable contacts 15.

Figure 4:
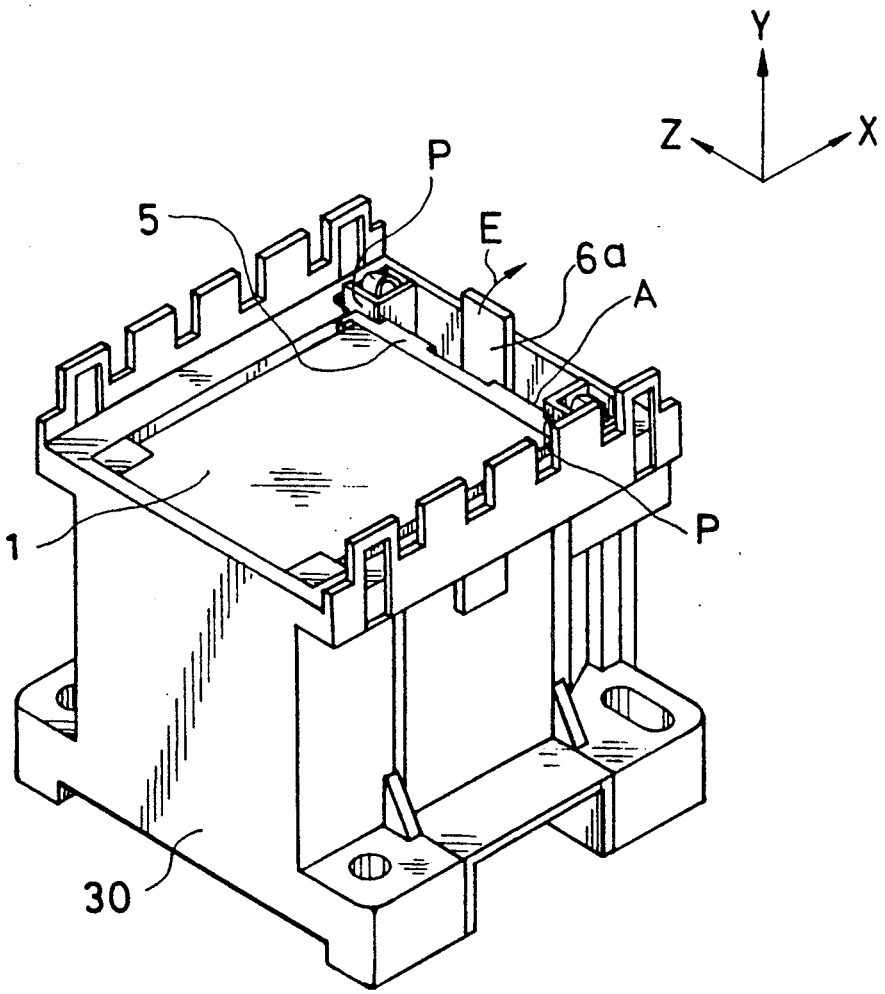
FIG. 4 is a perspective view showing a case 30 in FIG. 1 with the electromagnet part A mounted completely.
Figure 6:
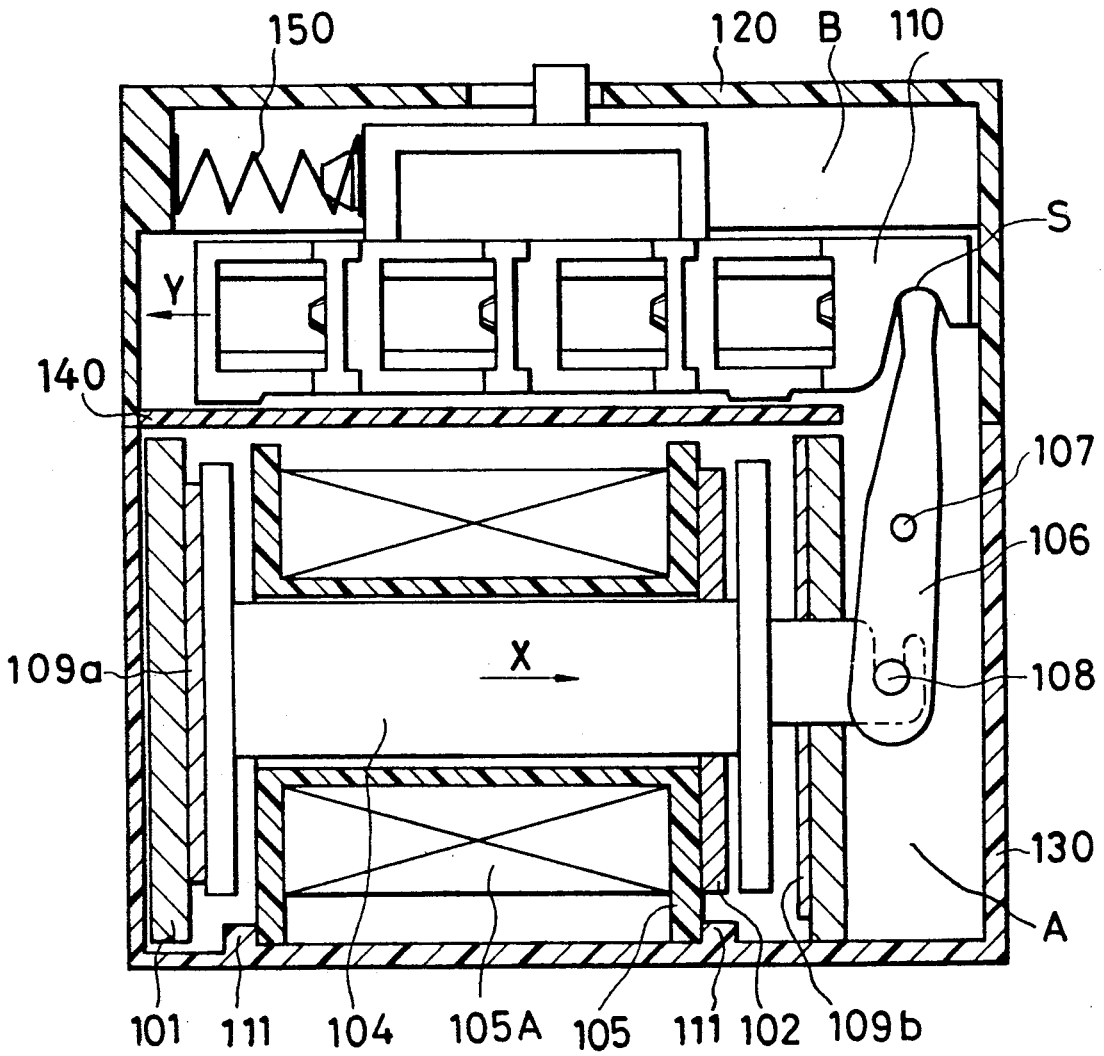
FIG.6 (Prior Art)
FIG. 6 is a cross-sectional view showing the conventional electromagnetic contactor.

FIG. 4 is a perspective view showing the case 30 into which the electromagnet part A (shown in FIG. 3*b*) is completely mounted. As shown in the figure, the flat board part 6*a* is projected out of the case 30 in a Y-direction. By pushing the flat board part 6*a* by a worker's finger or a tool along an arrow E, position of the flat board part 6*a* in a X-direction is relatively adjusted against a reference surface P of the coil spool 5. Since the crossbar 10 (FIG. 1) always abuts on the flat board part 6*a*, an initial position (a released position) of the crossbar 10 in its slidable direction is determined in accordance with a degree of bent in the flat board part 6*a*. It is thereby possible to adjust the over-travel of the contacts and a gap between the fixed contacts 17 and the movable contacts 15. Both amounts of the overtravel and the gap control an operation (attraction)

characteristic and a lifetime of the contacts, thereby greatly influencing a performance of the electromagnetic contactor. Since the above-mentioned adjustment is carried out only by adjusting (bending) the link 6, the spacers 9*a* and 9*b* mainly serve to adjust only the attraction force. Therefore, even after completion of the electromagnetic contactor, the adjustment can be realized only by removing the cover 20 (FIG. 1) without disassembling the electromagnet part A. Further, in the conventional electromagnetic contactor as shown in FIG. 6, it is impossible to make a correct adjustment when a desired position is not realized by the spacer having only a predetermined limited thickness, whereas fine and continuous adjustment is realized in the above-mentioned embodiment.

Figure 4A:
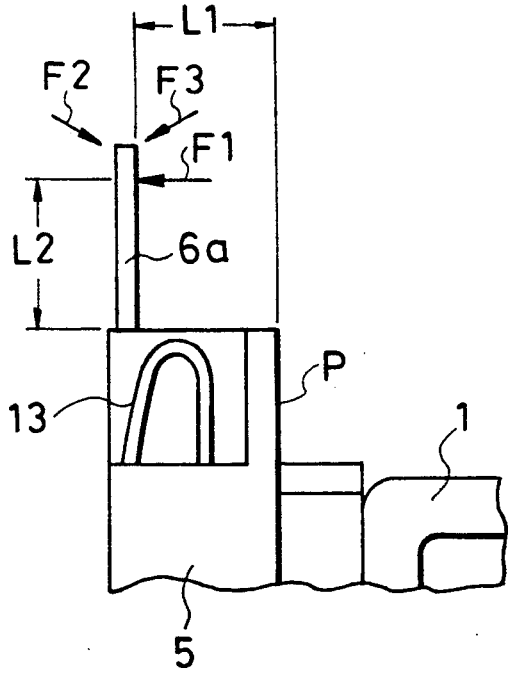
FIG. 4*a* is a partial side view from an arrow Q in FIG. 3*b*.

FIG. 4*a* is a partial side view from an arrow Q in FIG. 3*b*. With reference to FIG. 4*a*, a method for adjusting a length L1 between the flat board part 6*a* of the link 6 and the reference surface P is described. Under the condition that the coil 5A (FIG. 1) is excited and a pushing force F1 (for instance 100 g) is given to the flat board part 6*a* at a position with a length L2 away from an upper end of the coil spool 5, the length L1 is measured by a special measuring instrument (not shown). When the instrument reading is more than a predetermined value, an adjusting force F2 is given to the flat board part 6*a* from the left. When the instrument reading is less than the value, an adjusting force F3 is given to the flat board part 6*a* from the right.

As for the gap between the fixed contact 17 and the movable contact 15, the adjustment therefor can be easily carried out by a special tool.

Figure 5:
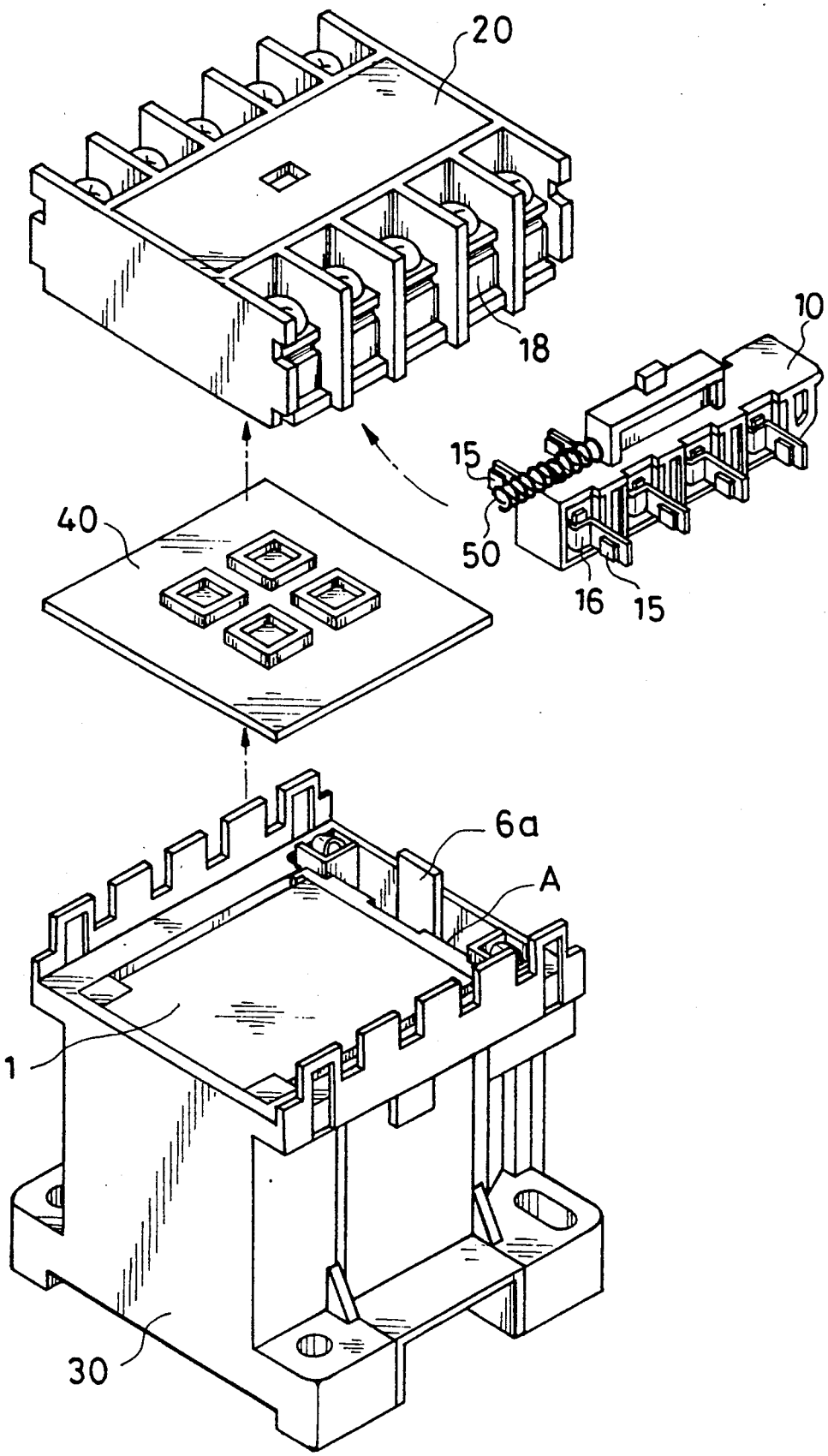
FIG. 5 is a perspective view showing main parts of the electromagnetic contactor of the present invention at an assembling stage.

FIG. 5 is a perspective view showing the cover 20, the shielding sheet 40, the crossbar 10 and the case 30 including the electromagnet part A. An assembling procedure of the electromagnetic contactor after completion of the above-mentioned adjustment is described. First, the crossbar 10 provided with the movable contacts 15 etc. is inserted in the cover 20 from its lower part. Second, the shielding sheet 40 is fitted to the lower part of the cover 20. Finally, the cover 20 including the crossbar 10 is mounted onto the case 30.

In the above-mentioned embodiment, the link 6 has a specific configuration as shown in FIG. 2. However, another configuration can be applied equivalently. An essential requirement for the link 6 is to have both proper rigidity and plasticity which allow to transform its shape by a strong force for adjusting, but on the other hand, maintain the adjusted configuration against a force transmitted therethrough during the operation. A mechanism having similar functions to the plasticity and the rigidity can be used in place of the link 6 of single material.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. An electromagnetic contactor comprising:

a casing;

a cover coupled with said casing;

an electromagnet unit including an electromagnet fixedly mounted in said casing and a movable iron core movably mounted in said casing;

a fixed contact fixedly mounted in said cover;

a crossbar which is slidably mounted in said cover and which includes a movable contact for moving in and out of contact with said fixed contact;

a spring for urging said crossbar to move toward a predetermined direction; and an adjusting link which has a first end part for engaging with said movable iron core and a second end part for moving said crossbar against an urging force of said spring, said second end part having a flat-board-shape and projecting out of said casing.

2. An electromagnetic contactor comprising:

a casing;

a cover coupled with said casing;

an electromagnet unit including an electromagnet fixedly mounted in said casing and a movable iron core movably mounted in said casing;

a fixed contact fixedly mounted in said cover;

a crossbar which is slidably mounted in said cover close to said electromagnet, and which includes a movable contact for moving in and out of contact with said fixed contact:

a spring for urging said crossbar to move toward a predetermined direction;

a link which has a first end part for engaging with said movable iron core and a second end part for moving said crossbar against an urging force of said spring, said link linking said movable iron core with said crossbar; and adjusting means provided between said first end part and said second end part, said adjusting means having a predetermined rigidity for adjusting a gap between said fixed contact and said movable contact.

3. An electromagnetic contactor in accordance with claim 2, wherein said adjusting means is made of a rigid body with plasticity.

4. An electromagnetic contactor comprising:

a casing;

a cover coupled with said casing;

an electromagnet unit including an electromagnet fixedly mounted in said casing and a movable iron core movably mounted in said casing;

a fixed contact fixedly mounted in said cover;

a crossbar which is mounted for sliding motion in a first direction in said cover and which includes a movable contact for moving in and out of contact with said fixed contact;

a spring for urging said crossbar to move toward a predetermined direction; and an adjusting link which has a first end part for engaging with said movable iron core and a second end part for moving said crossbar against an urging force of said spring, said second end part projecting out of said casing and having a flat-board-shape which extends in a plane substantially perpendicular to said first direction.

* * * * *

UNITED STATES PATENT AND TRADEMARK OFFICE

CERTIFICATE OF CORRECTION

PATENT NO. : 5,075,660

DATED : December 24, 1991

INVENTOR(S) : Shigeharu OOTSUKA, et al.

It is certified that error appears in the above-identified patent and that said Letters Patent is hereby corrected as shown below: On the title page, Item

[54] ELECTROMAGNETIC CONTACTOR AND FABRICATION METHOD THEREFOR

Signed and Sealed this

Thirtieth Day of March, 1993

*Attest:*

STEPHEN G. KUNIN

*Attesting Officer*

*Acting Commissioner of Patents and Trademarks*